US006199657B1

(12) United States Patent
Misawa et al.

(10) Patent No.: US 6,199,657 B1
(45) Date of Patent: Mar. 13, 2001

(54) MOTOR VEHICLE INTAKE MUFFLER DUCT

(75) Inventors: Kichiji Misawa, Wako; Michio Yamamura; Minoru Hasegawa, both of Kobe, all of (JP)

(73) Assignees: Honda Giken Kogyo Kabushiki Kaisha, Tokyo; Tigers Polymer Coporation, Osaka, both of (JP)

( * ) Notice: Subject to any disclaimer, the term of this patent is extended or adjusted under 35 U.S.C. 154(b) by 0 days.

(21) Appl. No.: 09/417,998

(22) Filed: Oct. 13, 1999

(30) Foreign Application Priority Data

Oct. 14, 1998 (JP) ..... 10-291602

(51) Int. Cl.[7] ..... F02M 35/12
(52) U.S. Cl. ..... 181/229; 181/224
(58) Field of Search ..... 181/224, 229, 181/250, 266, 272

(56) References Cited

U.S. PATENT DOCUMENTS 4,295,416 * 10/1981 Gorchev et al. ..... 98/33 R
5,559,310 * 9/1996 Hoover et al. ..... 181/230
5,783,782 * 7/1998 Sterret et al. ..... 181/272
5,928,043 * 7/1999 Rinzaki ..... 440/77
6,079,516 * 6/2000 Pearson ..... 181/254

FOREIGN PATENT DOCUMENTS 4-318269 11/1992 (JP) .

* cited by examiner

*Primary Examiner*—Paul Ip
(74) *Attorney, Agent, or Firm*—Arent Fox Kintner Plotkin & Kahn, PLLC

(57) ABSTRACT

A motor vehicle intake muffler duct is formed by integrally bonding an upper duct, a lower duct and a separator interposed between them. Three airways are formed between the upper duct and the separator, seven muffler chambers are formed between the lower duct and the separator, and the airways and the muffler chambers are communicated with each other through vent holes which are formed in the separator. An intake muffler duct in which multiple muffler chambers are integrated with the airways, can be formed from only three components, which are an upper duct, a lower duct and a separator, and moreover although it has a compact structure, it is possible to reduce the intake noise effectively.

7 Claims, 7 Drawing Sheets

MOTOR VEHICLE INTAKE MUFFLER DUCT

BACKGROUND OF THE INVENTION

1. Field of the Invention

The present invention relates to an intake muffler duct for motor vehicles which guide air to the motor vehicle engine as well as reduce the intake noise.

2. Description of the Prior Art

The intake duct which supplies air to the engine of a motor vehicle is equipped with an intake muffler in order to reduce the intake noise, and with regard to such intake mufflers there are expansion type mufflers, Helmholtz type mufflers, side branch type mufflers, etc. Since it is difficult to reduce the intake noise in all frequency regions using a single intake muffler, multiple intake mufflers each of which reduces the intake noise in a specific frequency range are combined so as to reduce the intake noise over a wide frequency range (see for example Japanese Patent Application Laid-open No. 4-318269).

However, since an engine and a large number of accessories are placed in the motor vehicle engine compartment, it is difficult to ensure that there is space to install multiple intake mufflers. In addition, if multiple intake mufflers are installed independently, the number of components, the number of processing steps and the number of assembly steps increase, resulting in an increase in cost.

SUMMARY OF THE INVENTION

The present invention has been conducted in view of the above-mentioned circumstances, and it is an objective of the present invention to provide a motor vehicle intake muffler duct which has a compact structure with a small number of components and can effectively reduce intake noise.

In accordance with a first feature of the present invention in order to achieve the above-mentioned objective, a motor vehicle intake muffler duct which introduces air to the engine of the motor vehicle and reduces the intake noise is characterized in that it is formed by integrally bonding a flattened upper duct and a flattened lower duct with a board or plate-shaped separator interposed between them. An airway whose ends are communicated with an air inlet and an air outlet, is formed between the upper duct and the separator, and a multiple number of muffler chambers which are separated from each other by partitions, are formed between the lower duct and the separator. The airway and the muffler chambers are communicated with each other through vent holes which are formed in the separator.

In accordance with the above-mentioned arrangement, since the airway is formed between the upper duct and the separator, the multiple number of muffler chambers are formed between the lower duct and the separator and the airway and the multiple number of muffler chambers are communicated with each other through the vent holes which are formed in the separator, not only can an intake muffler duct integrally comprising an airway and multiple muffler chambers be formed from only the three components of the upper duct, lower duct and separator, but intake noise can also be reduced effectively. In addition, the entire intake muffler duct has a flattened shape and therefore it can be compactly stored in a small space inside motor vehicle engine compartment. Furthermore, the partitions which separate the multiple muffler chambers function as reinforcing ribs thus enhancing the rigidity of the lower duct.

In accordance with a second feature of the present invention, the motor vehicle intake muffler duct is characterized in that multiple airways are formed in parallel by partitions which are formed in the upper duct.

In accordance with the above-mentioned arrangement, since the multiple airways are formed in parallel by forming the partitions in the upper duct, it becomes easier to tune the muffler characteristics in comparison with the case where there is only one airway. Furthermore, since the partitions which separate the multiple airways function as reinforcing ribs, the rigidity of the upper duct is thus enhanced.

In accordance with a third feature of the present invention, the motor vehicle intake muffler duct is characterized in that a side branch type muffler is formed by introducing one vent hole into one muffler chamber.

In accordance with the above-mentioned arrangement, since one vent hole is introduced into the one muffler chamber, the side branch type muffler is formed and thus a muffler effect can be exhibited.

In accordance with a fourth feature of the present invention, the motor vehicle intake muffler duct is characterized in that an interference type muffler is formed by introducing two vent holes into one muffler chamber.

In accordance with the above-mentioned arrangement, since the two vent holes are introduced into the one muffler chamber, the interference type muffler is formed and thus a muffler effect can be exhibited.

In accordance with a fifth feature of the present invention, the motor vehicle intake muffler duct is characterized in that the periphery of a vent hole is made so as to protrude with a tubular or cylindrical shape.

In accordance with the above-mentioned arrangement, since the periphery of the vent hole is made so as to protrude with a tubular shape, the above-mentioned vent hole functions as a vent tube having a predetermined length and thus the degrees of freedom in setting the muffler characteristics can be increased.

The above-mentioned objectives, other objectives, characteristics and advantages of the present invention will be elucidated by a preferred embodiment described in detail below by reference to the attached drawings.

DETAILED DESCRIPTION OF THE PREFERRED EMBODIMENT

The present invention is described below by reference to the Embodiment of the present invention shown in the attached drawings.

FIG. 1 to FIG. 8 illustrate one embodiment of the present invention.

Figure 1:
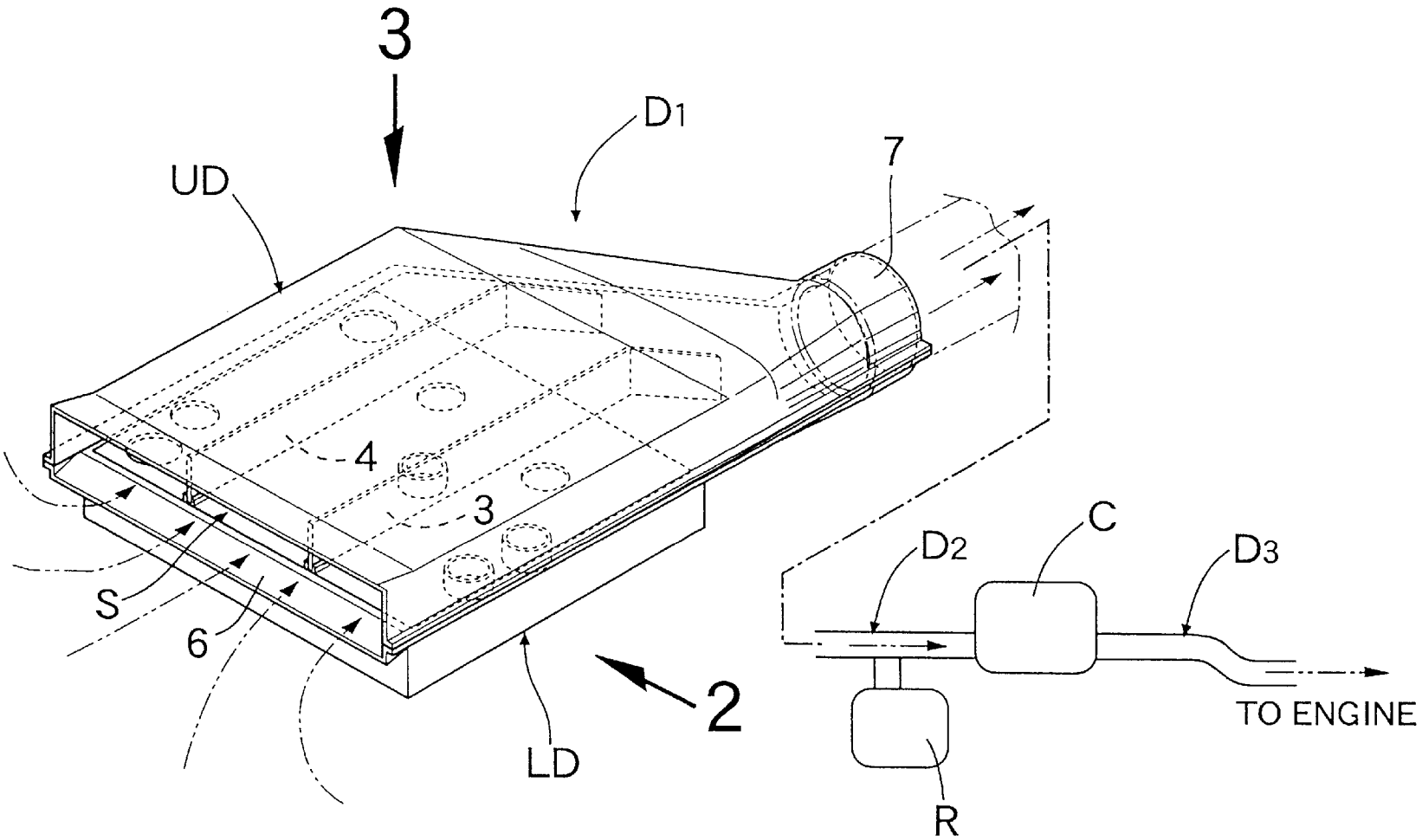
FIG. 1 is a perspective view of an entire intake muffler duct according to one embodiment of the present invention.
Figure 2:
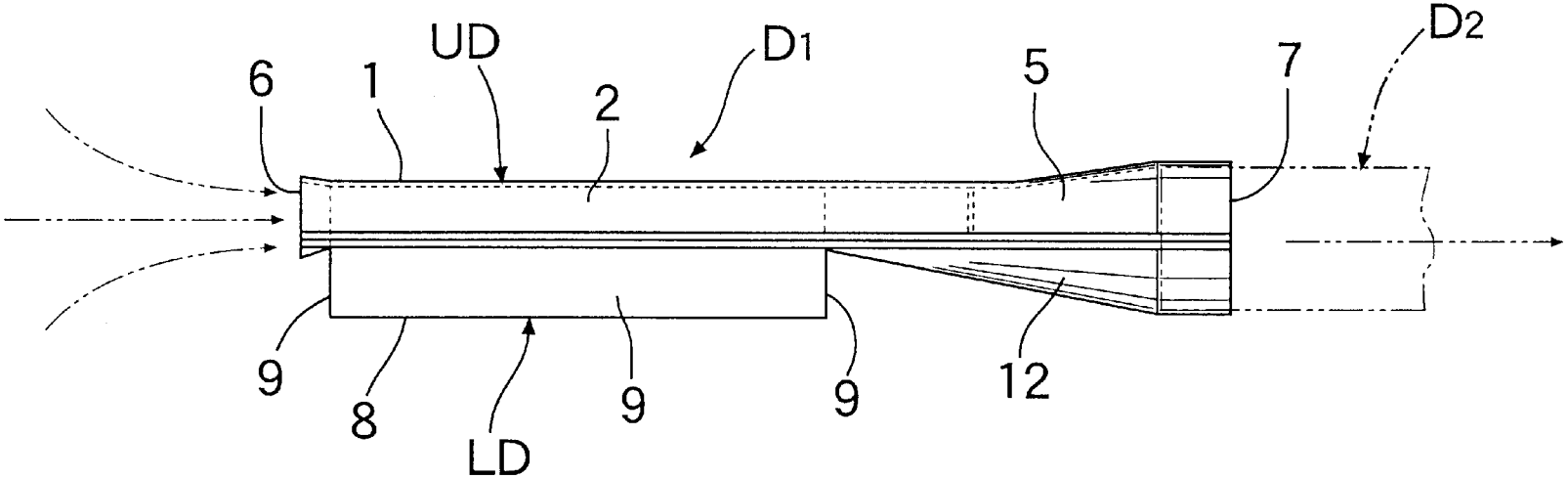
FIG. 2 is a view in the direction shown by arrow 2 in FIG. 1.
Figure 3:
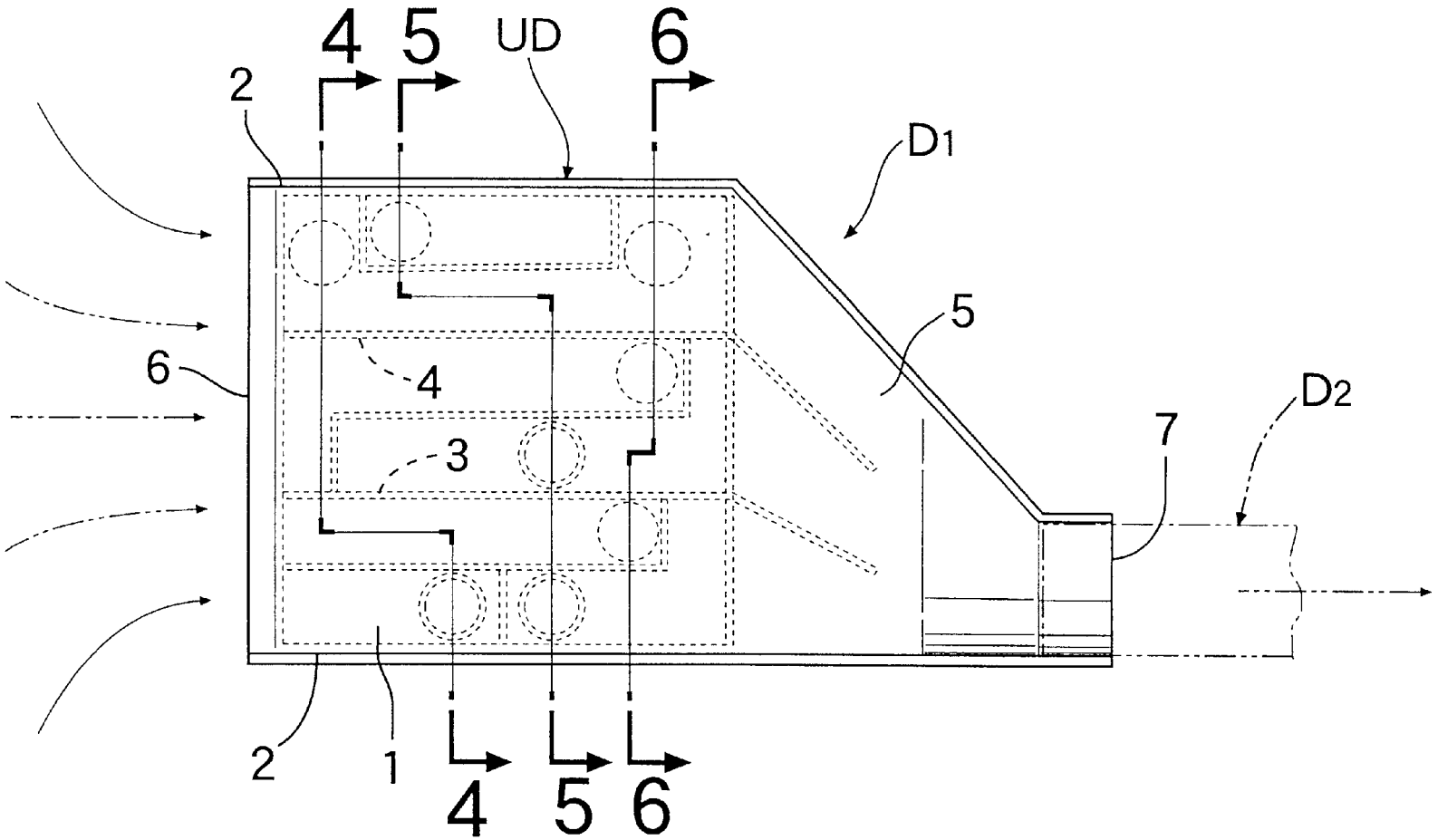
FIG. 3 is a view in the direction shown by arrow 3 in FIG. 1.

As shown in FIG. 1, an intake path which introduces air to an engine mounted in a motor vehicle engine compartment comprises a first intake duct $D_1$ which forms the intake muffler duct of the present invention, a second intake duct $D_2$ which is communicated with the downstream side of the first intake duct $D_1$ and is integrally equipped with a resonator type intake muffler R and a third intake duct $D_3$ which is communicated with the downstream side of the second intake duct $D_2$ via an air cleaner C. The first intake duct $D_1$ has a flattened shape in its vertical direction and by placing this within the engine compartment so as to abut the underside of the bonnet of the motor vehicle, the small space inside the engine compartment can be used effectively.

The structure of the first intake duct $D_1$ is explained in detail below by reference to FIG. 1 to FIG. 7.

The first intake duct $D_1$ is formed from three components, which are an upper duct UD, a lower duct LD and a separator S, all being formed by the injection moulding of a synthetic resin. The upper duct UD is a flattened component having a generally pentagonal outline and an open base and integrally comprises a flat top wall 1, two side wall sheets 2, 2 which hang down from the right and left edges of the top wall 1, two partition sheets 3, 4 which project downwards from the lower surface of the top wall 1, and an air convergence part 5 which extends backwards from the back edges of the top wall 1 and the side walls 2, 2. At the upstream end of the upper duct UD an air inlet 6 is formed having a long horizontal rectangular shape which is directly open to the air. At the downstream end of the upper duct UD the air convergence part 5 changes its cross section from rectangular to semicircular so as to form the upper half of an air outlet 7. Since the two partition sheets 3, 4 also function as reinforcing ribs, the rigidity of the upper duct UD can be enhanced.

The lower duct LD is a flattened component having the same outline shape as that of the above-mentioned upper duct UD and an open top and comprises a flat base wall 8, four side wall sheets 9 which rise from the periphery thereof, multiple partitions 10 which multiply partition tray-shaped space surrounded by the base wall 8 and the side walls 9, an air guide 11 which extends forwards and downwards from the top of the front side wall 9 so as to form the tail of the above-mentioned air inlet 6, and an air convergence part 12 which extends rearward and downwards from the top of the rear side wall 9. The cross section of the rear edge of the air convergence part 12 has a semicircular shape and together with the air convergence part 5 of the upper duct UD forms the above-mentioned outlet 7 whose cross section has a circular shape. Since the partitions 10 function as reinforcing ribs, the rigidity of the lower duct LD can be enhanced.

The separator S is a square-shaped plate or board component in which eight vent holes $\mathbf{13}_1$ to $\mathbf{13}_8$ are formed, and two lines of locating channels 14, 15 are formed so as to project from the top surface thereof. The separator S is fitted into the top end parts of the four side walls 9 of the lower duct LD and on the top thereof the upper duct UD is further superimposed. The lower duct LD, the separator S and the upper duct UD are integrally bonded by melt bonding the parts thereof which are in contact with each other.

When the upper duct UD and the separator S are joined, the lower ends of the two partitions 3, 4 of the upper duct UD fit into the two locating channels 14, 15 of the separator S so as to form three airways 16, 17, 18 in parallel above the separator S which are separated by the two partitions 3, 4. The upstream end of each of the airways 16, 17, 18 is communicated with the air inlet 6 and the downstream ends thereof are combined inside the upper and lower air convergence parts 5, 12 and then communicated with the air outlet 7. In the embodiment the forward ends of the partitions 3, 4 only reach a position slightly in from the air inlet 6, but these forward ends may be extended to the position of the air inlet 6.

By integrally forming the lower duct LD and the separator S, seven muffler chambers $\mathbf{19}_1$ to $\mathbf{19}_7$ are formed. The upper and lower surfaces thereof are made from the separator S and the bottom wall 8 and the side walls thereof are made from the side walls 9 and the partitions 10. Among the seven muffler chambers $\mathbf{19}_1$ to $\mathbf{19}_7$, six muffler chambers $\mathbf{19}_1$ to $\mathbf{19}_6$ form side branch type mufflers, and each thereof is communicated with the airways 16, 17, 18 via one of the vent holes $\mathbf{13}_1$ to $\mathbf{13}_6$. That is to say, as is clear from referring also to FIG. 8, the muffler chambers $\mathbf{19}_1$ to $\mathbf{19}_3$ are communicated with the airway 16 via the vent holes $\mathbf{13}_1$ to $\mathbf{13}_3$ respectively, the muffler chambers $\mathbf{19}_4$, $\mathbf{19}_5$ are communicated with the airway 17 via the vent holes $\mathbf{13}_4$, $\mathbf{13}_5$ respectively and the muffler chamber $\mathbf{19}_6$ is communicated with the airway 18 via the vent hole $\mathbf{13}_6$. The remaining muffler chamber $\mathbf{19}_7$ forms an interference type muffler (a bypass type muffler) and is communicated with the airway 18 via two vent holes $\mathbf{13}_7$, $\mathbf{13}_8$ which open at the two ends of the chamber.

Figure 4:
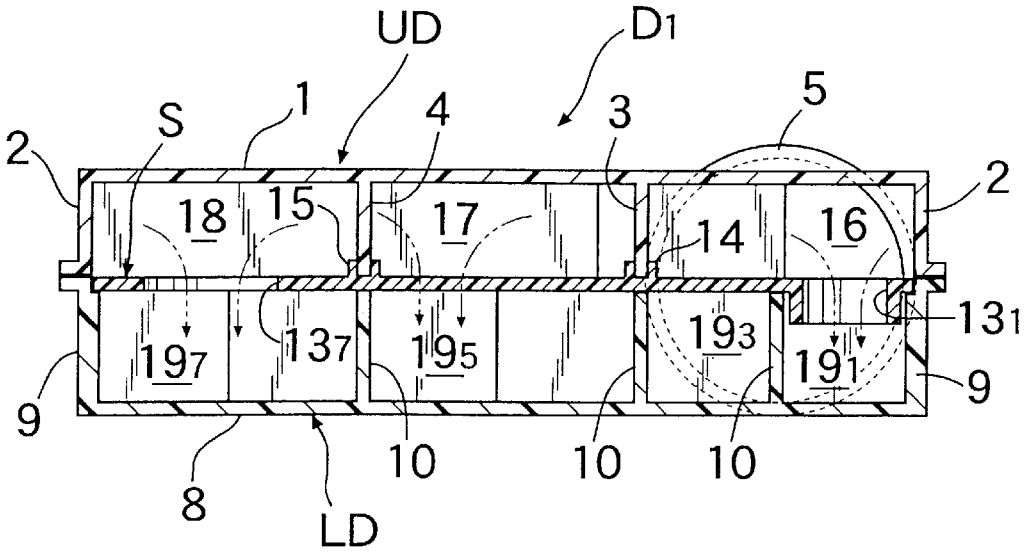
FIG. 4 is a cross-sectional view at line 4—4 in FIG. 3.
Figure 5:
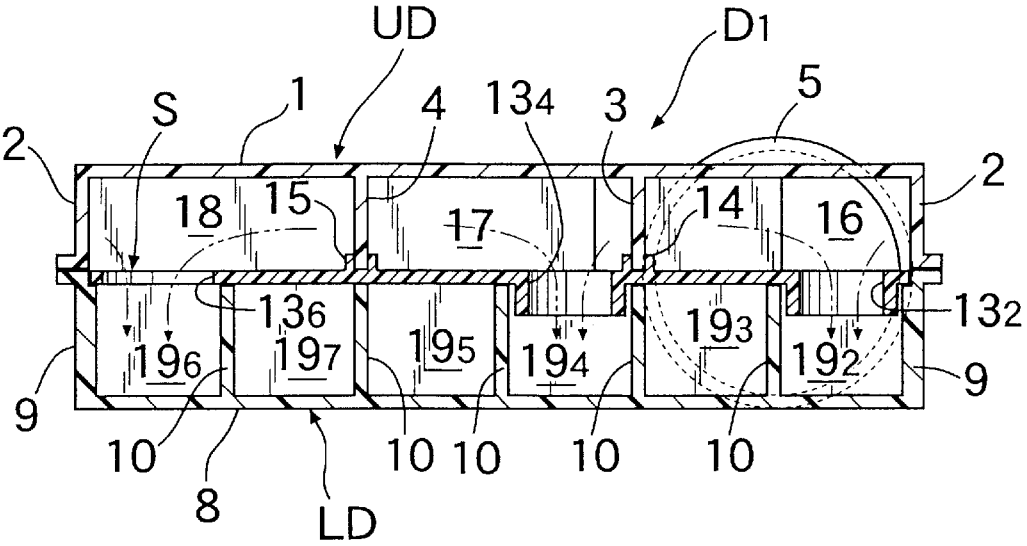
FIG. 5 is a cross-sectional view at line 5—5 in FIG. 3.
Figure 6:
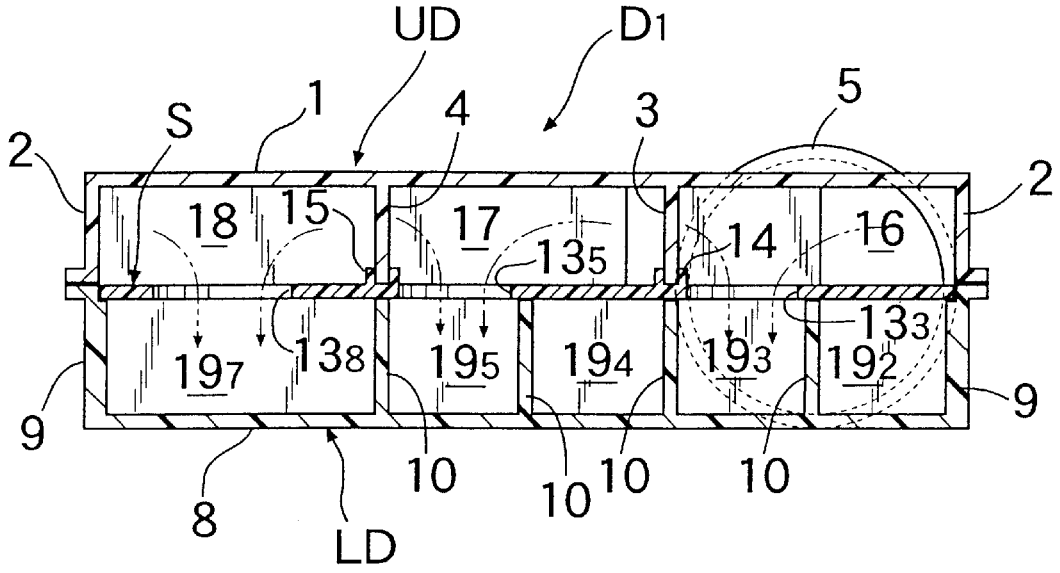
FIG. 6 is a cross-sectional view at line 6—6 in FIG. 3.
Figure 7:
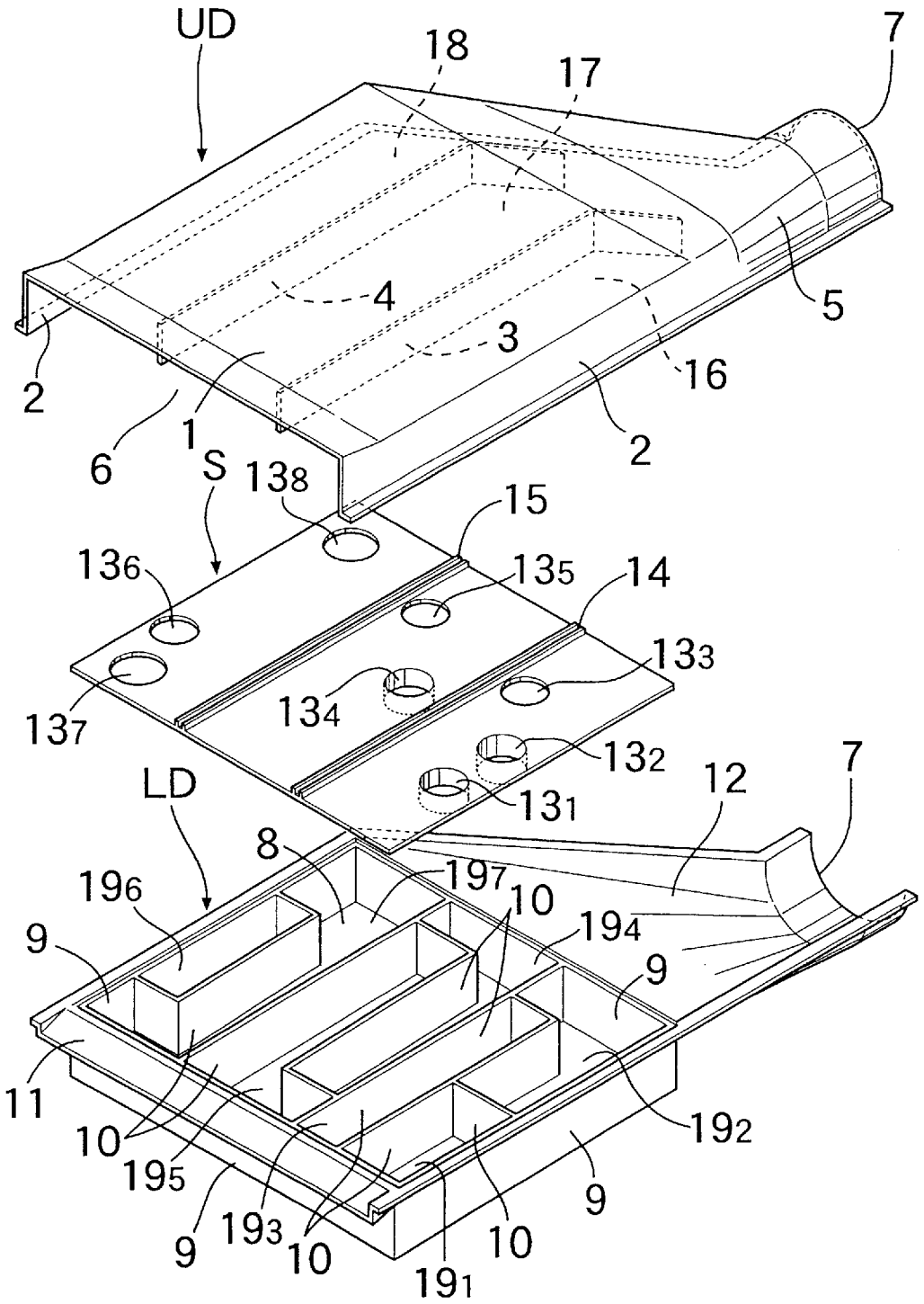
FIG. 7 is a perspective view of a disassembled intake muffler duct.
Figure 8:
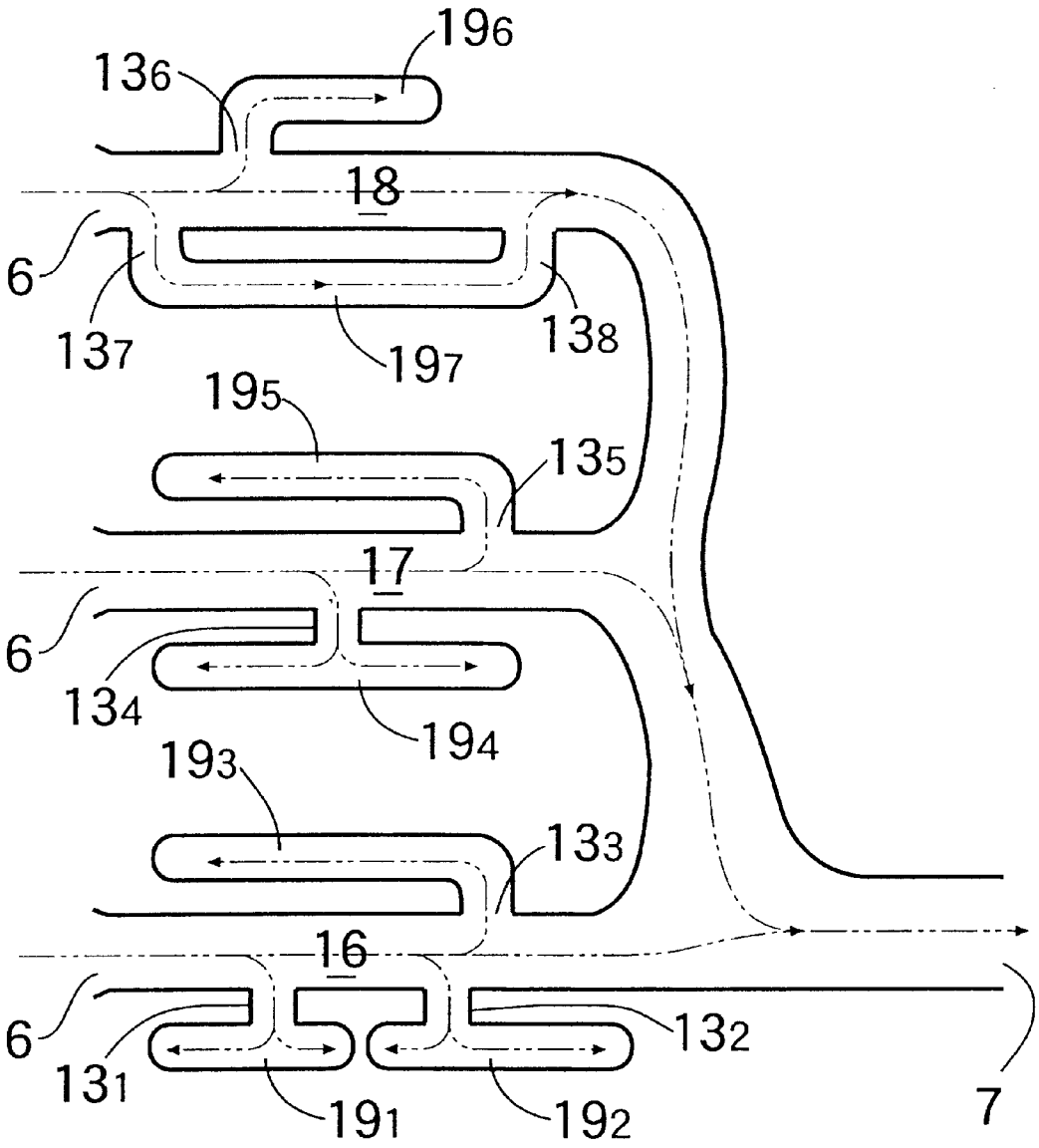
FIG. 8 is a schematic of an intake muffler duct.

As is clear from FIG. 4, FIG. 5 and FIG. 7, among those eight vent holes $\mathbf{13}_1$ to $\mathbf{13}_8$ formed on the separator S three vent holes $\mathbf{13}_1$, $\mathbf{13}_2$, $\mathbf{13}_4$ have short tubular shapes on their peripheries which project downwards.

Next, the action of the embodiment of the present invention having the above-mentioned arrangement is explained.

Air which is taken in by the vacuum suction generated by the operation of the engine is supplied to the engine through the first intake duct $D_1$, the second intake duct $D_2$ and the third intake duct $D_3$. At this stage, the air taken in via the air inlet 6 of the first intake duct $D_1$ splits into the three airways 16, 17, 18 which are formed by the partitions 3, 4 and then converges in the air convergence parts 5, 12 so as to be supplied to the second intake duct $D_2$ via the air outlet 7.

The three airways 16, 17, 18, through which the air taken in into the first intake duct $D_1$ flows, are communicated with six muffler chambers $\mathbf{19}_1$ to $\mathbf{19}_6$ via six vent holes $\mathbf{13}_1$ to $\mathbf{13}_6$ respectively, and therefore by these six muffler chambers $\mathbf{19}_1$ to $\mathbf{19}_6$ functioning as side branch type mufflers the intake noise can be reduced. Since the airway 18 is communicated with both ends of the muffler chamber $\mathbf{19}_7$ in the lengthwise direction via the two vent holes $\mathbf{13}_7$, $\mathbf{13}_8$, the muffler chamber $\mathbf{19}_7$ functions as an interference type muffler so as to reduce the intake noise.

In the above-mentioned embodiment, the three airways 16, 17, 18 are formed by the two partitions 3, 4, but it is possible to easily increase or decrease the number of airways 16, 17, 18 simply by changing the number of partitions 3, 4. Moreover, due to the formation of the three airways 16, 17, 18, it becomes easier to carry out tuning of the muffler characteristics in comparison with the case where only one airway is used. Although seven muffler chambers $\mathbf{19}_1$ to $\mathbf{19}_7$ are used in the embodiment, it is possible to easily increase or decrease the number and the volume of the muffler chambers $\mathbf{19}_1$ to $\mathbf{19}_7$ simply by changing the layout of the partitions 10.

Furthermore, by changing only the volume or the length of the muffler chambers $\mathbf{19}_1$ to $\mathbf{19}_7$ or the aperture area or the shape of the vent holes $\mathbf{13}_1$ to $\mathbf{13}_8$, it is possible to easily and freely carry out tuning of the muffler characteristics of each of muffler chambers $\mathbf{19}_1$ to $\mathbf{19}_7$. In addition, since tubular shapes having a predetermined length are formed on the peripheries of the apertures of the three vent holes $\mathbf{13}_1$, $\mathbf{13}_2$, $\mathbf{13}_4$, it becomes possible for these vent holes $\mathbf{13}_1$, $\mathbf{13}_2$, $\mathbf{13}_4$ to function as vent tubes for the muffler chambers $\mathbf{19}_1$, $\mathbf{19}_2$, $\mathbf{19}_4$, and the range over which the muffler characteristics can be tuned can be further enlarged.

As hereinbefore described, since the seven muffler chambers $\mathbf{19}_1$ to $\mathbf{19}_7$ are integrally formed in the first intake duct $D_1$, it is possible to decrease the number of components, the number of processing steps and the number of assembly steps in comparison with the case in which seven muffler chambers $\mathbf{19}_1$ to $\mathbf{19}_7$ are formed individually. Moreover, since the overall shape of the first intake duct $D_1$ is flattened, by placing it against the lower surface of a bonnet, a small narrow space inside the engine compartment can be used effectively.

In the embodiment three airways 16, 17, 18 are formed, but the number thereof is not limited to three and it can be any number including one. Furthermore, the number and the layout of the muffler chambers $\mathbf{19}_1$ to $\mathbf{19}_7$ are not limited to those in the embodiment, and they can be changed appropriately.

The present invention may be embodied in other specific forms without departing from the spirit or essential characteristics thereof. The presently disclosed embodiments are therefore to be considered in all respects as illustrative and not restrictive, the scope of the invention being indicated by the appended claims, rather than the foregoing description, and all changes which come within the meaning and range of equivalency of the claims are, therefore, to be embraced therein.

What is claimed is:

1. A motor vehicle intake muffler duct for introducing air to the engine of a motor vehicle and reducing intake noise, said muffler duct comprising a flattened upper duct, a flattened lower duct, a separator positioned between said upper duct and said lower duct, an air inlet and an air outlet, an airway between said air inlet and said air outlet, said airway being formed between said upper duct and said separator, at least two muffler chambers formed between said lower duct and said separator, at least one partition extending between said lower duct and said separator for separating said muffler chambers, and at least one vent hole formed in said separator for communicating said airway and said muffler chambers with each other.

2. A motor vehicle intake muffler duct according to claim 1, wherein said separator is plate-shaped.

3. A motor vehicle intake muffler duct according to claim 1, wherein said upper duct, said lower duct, and said separator are integrally formed.

4. A motor vehicle intake muffler according to claim 1, including partitions between said upper duct and said separator for forming multiple airways in said upper duct.

5. A motor vehicle intake muffler according to claim 1, wherein one vent hole is formed in at least one muffler chamber, wherein said at least one muffler chamber forms a side branch-type muffler.

6. A motor vehicle intake muffler according to claim 1, wherein two vent holes are formed in at least one muffler chamber, wherein said at least one muffler chamber forms an interference-type muffler.

7. A motor vehicle intake muffler according to claim 1, further including a tubular portion extending from at least one of said vent holes, said tubular portion extending from said separator into said muffler chamber.

* * * * *